United States Patent [19]

Pfeifer et al.

[11] Patent Number: 4,805,785

[45] Date of Patent: Feb. 21, 1989

[54] SHELF UNIT

[75] Inventors: William Pfeifer, Springdale; Charles J. Stahl, Butler; David C. Fair, Evans City, all of Pa.

[73] Assignee: Armstrong Store Fixture Corporation, Pittsburgh, Pa.

[21] Appl. No.: 84,633

[22] Filed: Aug. 12, 1987

[51] Int. Cl.[4] ..... A47F 43/00

[52] U.S. Cl. ..... 211/188; 211/184; 211/181

[58] Field of Search ..... 211/188, 181, 194, 184; 108/60, 61; 206/513, 511, 512

[56] References Cited

U.S. PATENT DOCUMENTS

| | | | |
|---|---|---|---|
| 921,694 | 5/1909 | Hall . | |
| 1,648,025 | 11/1927 | Molloy . | |
| 2,600,191 | 6/1952 | Beach | 211/148 |
| 2,836,304 | 5/1958 | Furrer | 211/46 |
| 3,082,879 | 3/1963 | Wilson | 211/126 |
| 3,314,549 | 4/1967 | Goldreich et al. | 206/513 X |
| 3,703,964 | 11/1972 | Field | 211/184 |
| 3,752,352 | 8/1973 | Senecal | 220/19 |
| 4,079,836 | 3/1978 | von Stein et al. | 206/513 |
| 4,146,139 | 3/1979 | von Stein et al. | 206/513 X |
| 4,361,234 | 11/1982 | Hawes et al. | 206/505 |
| 4,391,378 | 7/1983 | Secon | 211/188 X |
| 4,444,320 | 4/1984 | Chap | 211/134 |
| 4,508,230 | 4/1985 | Ashton | 211/188 X |

FOREIGN PATENT DOCUMENTS

| | | |
|---|---|---|
| 943443 | 12/1963 | United Kingdom . |
| 1297916 | 11/1972 | United Kingdom . |

OTHER PUBLICATIONS

*Visual Merchandising & Store Design*, p. 19, Oct. 1986.

*Primary Examiner*—Reinaldo P. Machado
*Assistant Examiner*—Sarah A. Lechok Eley
*Attorney, Agent, or Firm*—Parmalee, Miller, Welsh & Kratz

[57] ABSTRACT

A shelf unit includes top and bottom, spaced, generally parallel and coextensive horizontal surfaces comprising a plurality of spaced, generally parallel and coextensive elongated horizontal members and a plurality of spaced, generally parallel and coextensive crossmembers extending generally perpendicularly to the elongated horizontal members. Left and right spaced, generally parallel and coextensive elongated vertical side walls comprise a plurality of spaced, generally parallel and coextensive vertical bars and a plurality of spaced, generally parallel and coextensive crossbars extending generally perpendicularly to the elongated vertical members. The upper and lower edges of the left and right side walls are secured to the outer edges of the top and bottom surfaces so that the left and right walls extend generally perpendicularly to the bottom and top surfaces to define a chamber. The left and right side walls have at least one U-shaped leg member extending downwardly therefrom beyond the bottom horizontal member. The leg members are adapted for hooking engagement with one of the crossbars of one of the left and right side walls of a lower shelf unit upon which the shelf unit is placed to releasably secure the shelf unit atop the lower shelf unit.

20 Claims, 2 Drawing Sheets

SHELF UNIT

BACKGROUND OF THE INVENTION

The invention relates to a shelf unit, and more particularly, to a shelf unit that can be stacked atop a lower shelf unit to form a shelf assembly.

Various types of stackable shelf units are well known in the art. Stackable shelf units having a top, bottom and two opposing sides are known in which legs extending downwardly from the two sides of the shelf unit overlap the outside of the top portions of the sides of a lower shelf unit when the shelf unit is placed atop the lower shelf unit so that the bottom of the shelf unit is flush with the top of the lower shelf unit. However, the legs of the shelf unit are not secured to the lower shelf unit in any way, and thus, a stack of such shelf units is not as stable as it might be and can not support the loads that it might if the stack of shelf units were more stable.

Similarly, U.S. Pat. No. 1,648,025 to Molloy discloses stackable baskets which have legs that overlap the top portion of a lower basket when the basket is placed atop a lower basket. U.S. Pat. Nos. 921,694 to Hall and 4,444,320 to Chap and British Pat. No. 943,443 to Carroll et al. describe a basket, shelf and rack, respectively, wherein the legs of the basket, shelf or rack simply rest on top of the lower basket, shelf or rack. U.S. Pat. Nos. 2,600,191 to Beach and 4,079,836 to Von Stein et al. and British Pat. No. 1,297,910 to Hago Products disclose rack, basket and rack assemblies, respectively, wherein the legs of the rack or basket are inserted between horizontal members on the sides of a lower rack or basket when the rack is placed atop the lower rack or basket. Various means of securing baskets and racks are known in the art in order to increase the stability of the stacks. Such units have been secured together by a pin as in U.S. Pat. No. 2,836,304 to Furrer or hooked together as in U.S. Pat. No. 4,456,125 to Chap.

Thus, it is desired to develop a stackable shelf unit that can be secured to a lower shelf unit in such a way that the stack is stable and can support heavy loads.

SUMMARY OF THE INVENTION

The shelf unit of the invention includes top and bottom, spaced, generally parallel and coextensive horizontal surfaces comprising a plurality of spaced, generally parallel and coextensive elongated horizontal members and a plurality of spaced, generally parallel and coextensive crossmembers extending generally perpendicularly to the elongated horizontal members. Left and right spaced, generally parallel and coextensive vertical side walls comprise a plurality of spaced, generally parallel and coextensive elongated vertical bars and a plurality of spaced, generally parallel and coextensive crossbars extending generally perpendicularly to the elongated vertical bars. The upper and lower edges of the left and right side walls are secured to the outer edges of the top and bottom surfaces so that the left and right side walls extend generally perpendicularly to the bottom and top surfaces to define a chamber. The left and right side walls have at least one U-shaped leg member extending downwardly therefrom beyond the bottom horizontal surface. The leg members are adapted for hooking engagement with one of the crossbars of one of the left and right side walls of a lower shelf unit upon which the shelf unit is placed to releasably secure the shelf unit atop the lower shelf unit.

A shelf assembly includes a plurality of shelf units of the invention stacked atop one another. Shelf units of separate stacks are connected by shelves.

The shelf units of the invention can be stacked together in a very stable, sturdy manner to form shelf assemblies due to the hooking engagement of the legs and crossbars of the side walls.

DETAILED DESCRIPTION OF THE PREFERRED EMBODIMENTS

Figure 1:
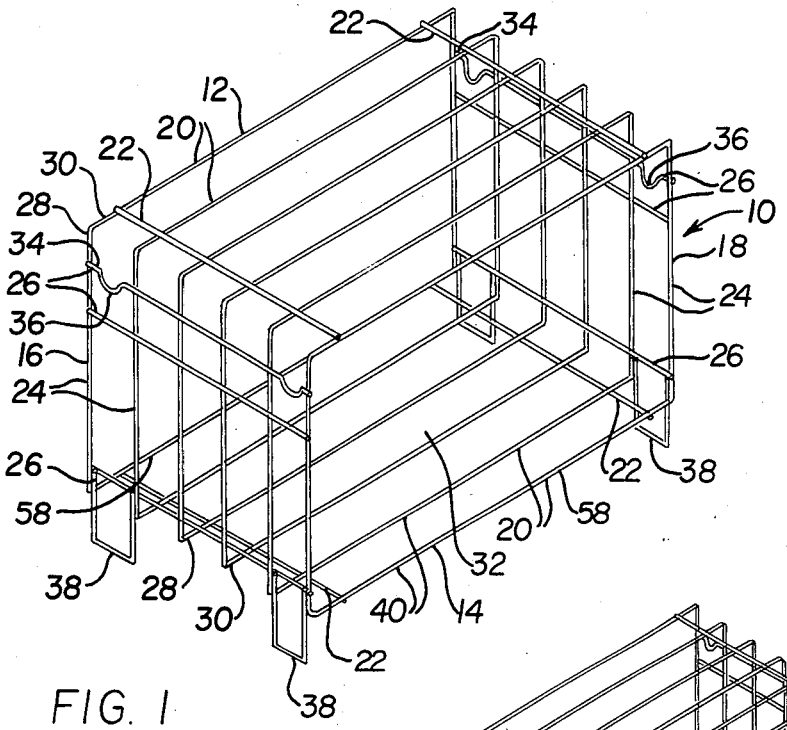
FIG. 1 is a perspective view of a shelf unit constructed according to the invention.

The shelf unit 10 of the present invention includes a top surface 12, bottom surface 14, left side wall 16 and right side wall 18.

The top surface 12 and bottom surface 14 include a plurality of spaced, generally parallel and coextensive elongated horizontal members 20 and a plurality of spaced, generally parallel and coextensive crossmembers 22 extending generally perpendicularly to the elongated horizontal members 20. The top surface 12 is spaced from, generally parallel to and coextensive with the bottom surface 14.

The left side wall 16 and the right side wall 18 are formed of a plurality of spaced, generally parallel and coextensive elongated vertical bars 24 and a plurality of spaced, generally parallel and coextensive crossbars 26 extending generally perpendicularly to the elongated vertical bars 24 The upper and lower edges 28 of the left side wall 16 and the right side wall 18 are secured to and extend between the outer side edges 30 of the top surface 12, and bottom surface 14 to define a chamber 32. Preferably, the uppermost crossbars 26, labeled 34, of the left side wall 16 and the right side wall 18 have a plurality of inwardly and downwardly directed indentations 36. Legs 38 coact with indentations **36*a* of a lower shelf unit 10*a* to releasably secure the shelf unit 10 atop the lower shelf unit 10*a***.

Preferably, each of the elongated horizontal members 20 of the top surface 12 and bottom surface 14 is attached to an elongated vertical bar 24 of the left side wall 16 and an elongated vertical bar 24 of the right side wall 18. Thus, two elongated horizontal members 20 and two elongated vertical bars 24 form a generally rectangular section 40. A plurality of the sections 40 are secured together by the crossmembers 22 and the crossbars 26 to form a shelf unit 10 of the invention. More preferably, the sections 40 are formed as a rectangle from a single elongated element.

Preferably, the crossmembers 22 of the top surface 12 and the crossmembers 22 of the bottom surface 14 are disposed without the chamber 32 and the crossmembers 22 of the top surface 12 are located at different distances from the left side wall 16 and right side wall 18 than are the crossmembers 22 of the bottom surface 14. Thus, the crossmembers **22*a* of the top surface 12*a* of the lower shelf unit 10*a* contact the bottom surface 14 of a shelf unit 10 and the crossmembers 22** of the bottom surface 14 of the shelf unit 10 contact the top surface 12*a* of the lower shelf unit 10*a* when the shelf unit 10 is placed atop the lower shelf unit 10*a*.

At least one U-shaped leg 38 extends downwardly from the left side wall 16 and the right side wall 18 beyond the bottom surface 14 of the shelf unit 10. The legs 38 are adapted to support the shelf unit 10 on a horizontal surface. Further, the legs 38 are adapted for hooking engagement with one of the crossbars 26*a* of the left side wall 16*a* and the right side wall 18*a* of a lower shelf unit 10*a* upon which the shelf unit 10 is placed to releasably secure the shelf unit 10 atop the lower shelf unit 10*a*. As illustrated in the drawings and described hereinbefore, with the present device, all of the crossbars of the sidewalls are located between the top and bottom horizontal surfaces and no portions of those crossbars or the engagement means extend above the top horizontal surfaces of the shelf unit.

Figure 2:
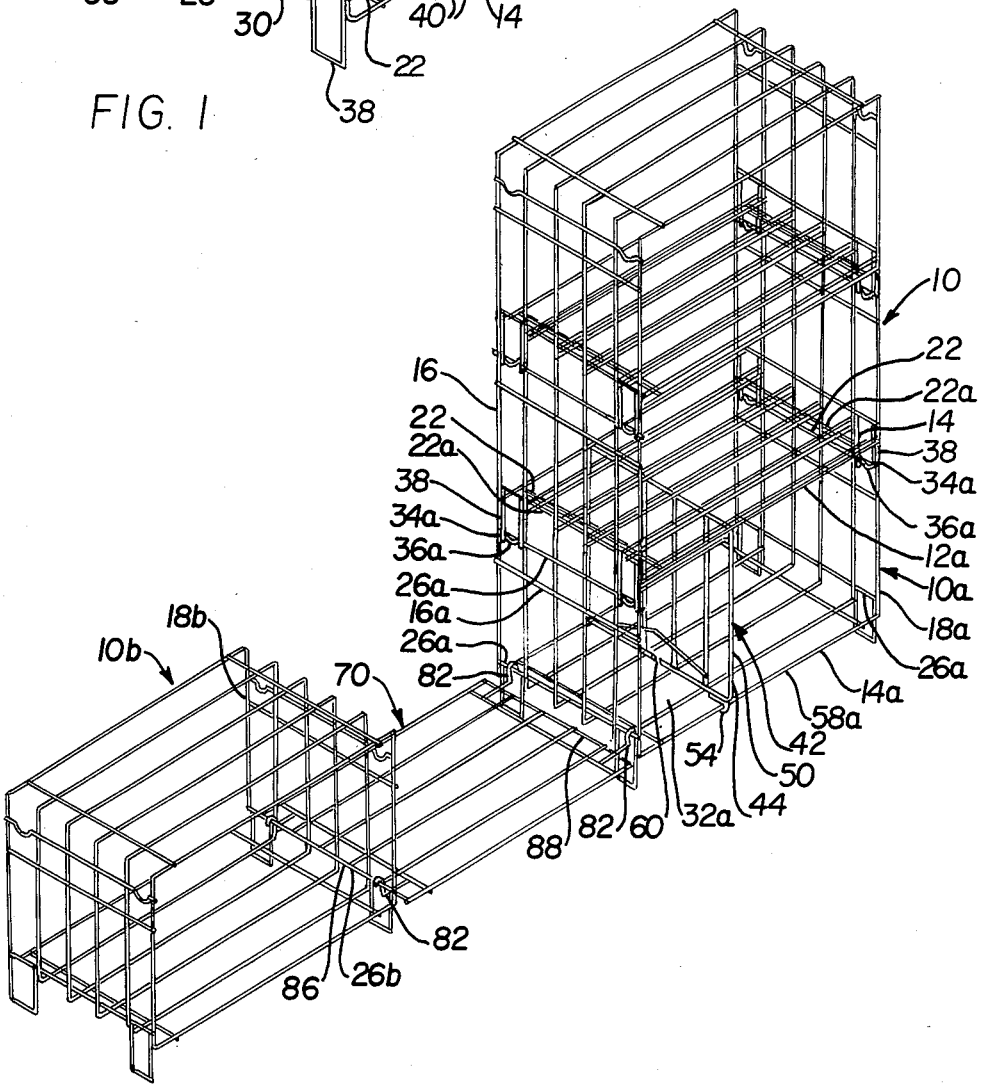
FIG. 2 perspective view of a shelf assembly constructed of a plurality of shelf units of the invention.

As shown in FIG. 2, in order to secure a shelf unit 10 of the invention atop a lower shelf unit 10*a*, the shelf unit 10 is placed atop the lower shelf unit 10*a* so that the crossmembers 22*a* of the top surface 12*a* of the lower shelf unit 10*a* contact the bottom surface 14 of the shelf unit 10 and the crossmembers 22 of the bottom surface 14 of the shelf unit 10 contact the top surface 12*a* of the lower shelf unit 10*a*. Thus, the top surface 12*a* of the lower shelf unit 10*a* is separated from the bottom surface 14 of the shelf unit 10 by the crossmembers 22*a* of the top surface 12*a* of the lower shelf unit 10*a* and the crossmembers 22 of the bottom surface 14 of the shelf unit 10. The legs 38 of the shelf unit 10 fit behind and under the indentations 36*a* in the uppermost crossbars 34*a* of the left side wall 16*a* and the right side wall 18*a* of the lower shelf unit 10*a* to hooking engagement with the uppermost crossbars 34*a* and releasably secure the shelf unit 10 atop the lower shelf unit 10*a*.

Figure 3:
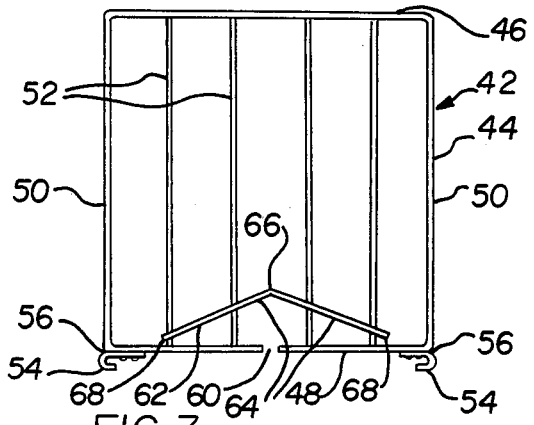
FIG. 3 is a perspective view of a divider that can be used in connection with a shelf unit of the invention.

As shown in FIGS. 2 and 3, the shelf unit of the invention can be used with a divider 42. The divider 42 includes a generally rectangular frame 44 having a top 46, bottom 48 and two vertical sides 50. The top 46 and bottom 48 of the frame 44 are the same length as the width of the top surface 12 and the bottom surface 14 of the shelf unit 10. The vertical sides 50 of the frame 44 are slightly shorter than the left side wall 16 and right side wall 18 of the shelf unit 10 so that the divider 42 fits tightly within the chamber 32 between the top surface 12 and bottom surface 14 of the shelf unit 10.

A plurality of spaced, generally parallel and coextensive elongated vertical bars 52 extend generally parallel to the vertical sides 50 between the top 46 and bottom 48 of the frame 44. J-shaped hook members 54 extend downwardly from the outer edges 56 of the bottom 48 of the frame 44 and are adapted to engage the outermost elongated members 58 of the bottom 14 of the shelf unit 10.

The bottom 48 of the frame 44 of the divider 42 is discontinuous at the center thereof thus defining gap 60. A V-shaped bar 62 having two legs 64 joined at an apex 66 is attached to the divider 42, spanning the gap 60 so that the V-shaped bar 62 abuts and is attached to the elongated vertical bars 52 of the divider 42 and the ends 68 of the legs 64 opposite the apex 66 of the V-shaped bar 62 are attached to the frame 44, one leg 64 on either side of the gap 60. Thus, the V-shaped bar 62 spans the gap 60 of the bottom 48 of the frame 44 and biases the bottom 48 to tend to close the gap 60.

Thus in order to place a divider 42 within the chamber 32*a* of the shelf unit 10*a* of FIG. 2, the divider 42 is placed within the chamber 32 of the shelf unit 10*a*. The vertical sides 50 of the frame 44 of the divider 42 are pulled apart to open the gap 60 sufficiently so that the hooks 54 engage the outermost elongated members 58*a* of the bottom 14*a* of the shelf unit 10*a*.

Figure 4:
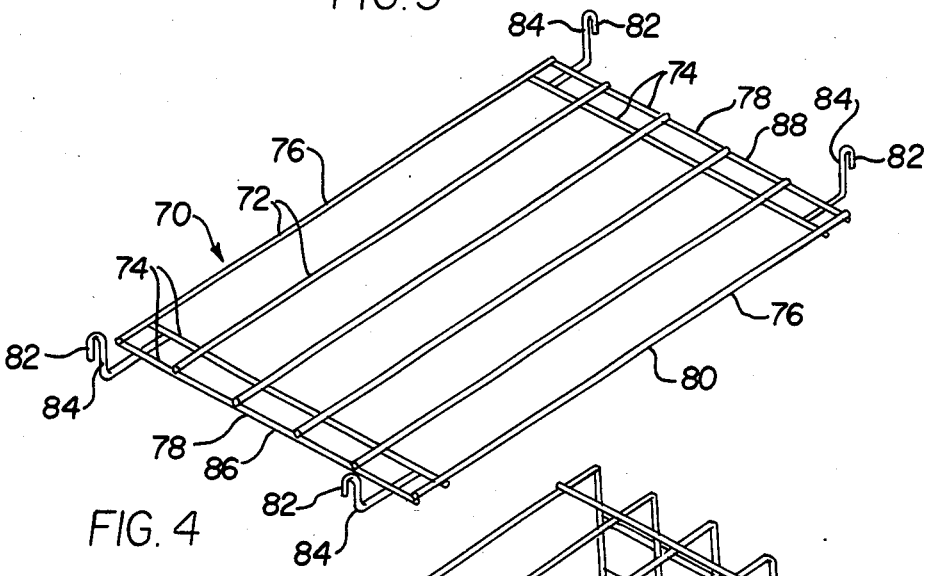
FIG. 4 is a perspective view of a shelf spacer that can be used in connection with a shelf unit of the invention.

As shown in FIGS. 2 and 4, a shelf 70 can be used to connect two horizontally adjacent shelf units 10*a* and 10*b* of the invention. The shelf 70 includes a plurality of spaced, generally parallel and coextensive elongated horizontal segments 72 and a plurality of spaced, generally parallel and coextensive crossmembers 74 extending generally perpendicularly to the elongated horizontal segments 72. The outermost horizontal segments 72, labeled 76, and the outermost crossmembers 74, labeled 78, form a generally rectangular frame 80. Hooks 82 are attached to and extend laterally from the outermost crossmembers 78 of the shelf 70. The hooks 82 include J-shaped portions 84 which are adapted to engage a crossbar 26 of a left side wall 16 or right side wall 18 of a shelf unit 10 of the invention.

Thus, in order to connect the shelf units 10*a* and 10*b* of FIG. 2 together with a shelf 70, the hooks 82 on the left side 86 of the shelf 70 engage a crossbar 26*b* on the right side wall 18*b* of the shelf unit 10*b* and the hooks 82 on the right side 88 of the shelf 70 engage a crossbar 26*a* on the left side wall 16*a* of the other shelf unit 10*a* so that the shelf 70 extends horizontally between two shelf units 10*a* and 10*b*.

Figure 5:
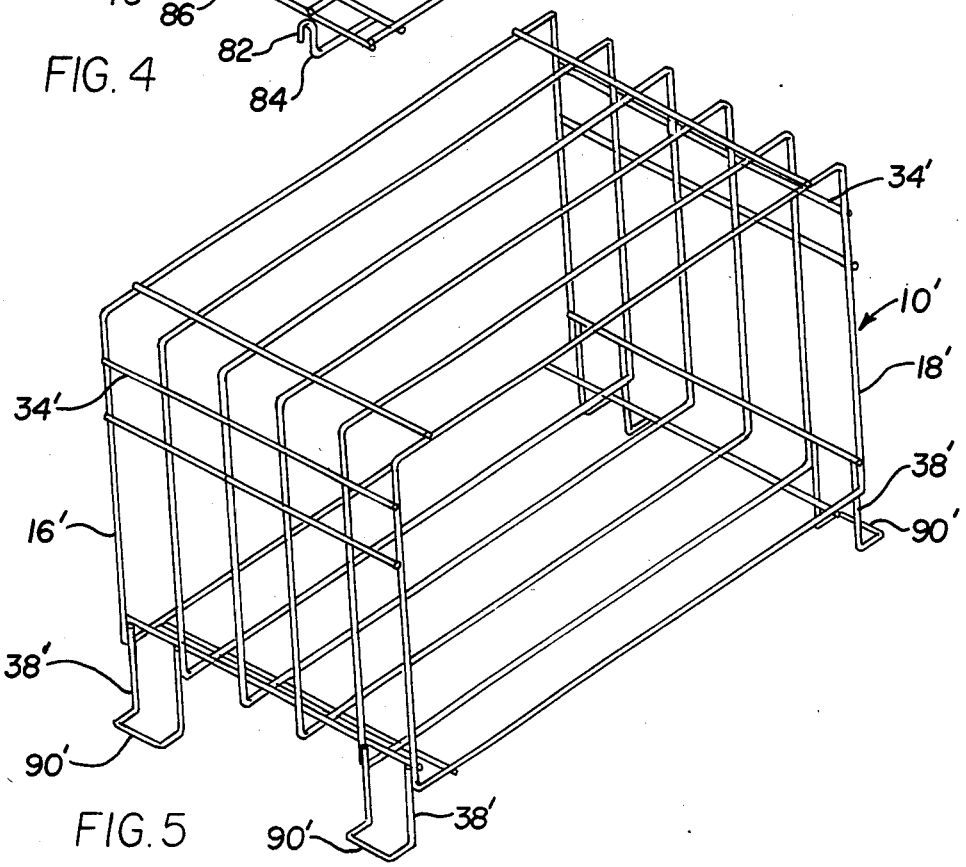
FIG. 5 is a perspective view of an alternative embodiment of a shelf unit of the invention.

In a second embodiment of the invention, shown in FIG. 5, the U-shaped legs 38′ of the shelf unit 10′ have horizontally and outwardly extending feet portions 90′ which fit behind and under the uppermost, generally straight crossbars 34′, of the left side wall 16′ and the right side wall 18′ of a lower shelf unit for hooking engagement with the crossbars 34′ and releasably secure the shelf unit 10′ atop a lower shelf unit.

The shelf unit 10, divider 42 and shelf 70 can be formed of any material having sufficient strength to support the desired load and sufficient flexibility to be formed into the desired shape. It is preferred that the shelf unit 10, divider 42 and shelf 70 be metal. Particularly the shelf unit should be formed of metal if the shelf unit 10 is formed from a plurality of sections 40 formed from a single elongated element. In addition, generally the metal forming the shelf unit 10, divider 42 and shelf 70 is coated with a plastic such as a vinyl to enhance the appearance of the shelf unit 10, divider 42 and shelf 70.

Thus, a shelf unit 10 of the invention can be secured atop a lower shelf unit 10*a* to form a sturdy shelf assembly. The hooking engagement between the crossbars 34*a* of the lower shelf unit 10*a* and legs 38 of the upper shelf unit 10 provides stability to the shelf assembly and enables the shelf assembly to support heavy loads.

What is claimed is:

1. A shelf unit comprising:

top and bottom, spaced, generally parallel and coextensive horizontal surfaces having outer edges and comprising a plurality of spaced, generally parallel and coextensive elongated horizontal members and a plurality of generally parallel, spaced and coextensive crossmembers extending generally perpendicularly to said elongated horizontal members;

left and right, spaced, generally parallel and coextensive vertical sidewalls comprising a plurality of spaced, generally parallel and coextensive elongated vertical bars and a plurality of spaced, generally parallel and coextensive crossbars extending generally perpendicularly to said elongated vertical bars, said left and right sidewalls secured to and extending between said outer edges and generally perpendicularly to said top and bottom surfaces to define a chamber;

each said sidewalls having at least one U-shaped leg member extending downwardly beyond said bottom horizontal surface forming engagement means, each said U-shaped leg member being adapted for hooking engagement with one of said crossbars of one of said sidewalls, between said outer edges of said top and bottom horizontal surfaces, of a lower shelf unit upon which said shelf unit is placed to releasably secure said shelf unit atop said lower shelf unit, all of said crossbars of said sidewalls being located between said top and bottom horizontal surfaces, with no portions thereof or engagement means extending above said top horizontal surface.

2. The shelf unit of claim 1 wherein each said elongated horizontal member of said bottom and top surfaces is attached to an elongated vertical bar of said right side wall and an elongated vertical member of said left side wall, and each said vertical elongated member of said left and right side walls is attached to an elongated horizontal member of said bottom surface and an elongated horizontal member of said top surface to form a generally rectangular section, and a plurality of said sections are secured together by said crossmembers and crossbars to form said shelf unit.

3. The shelf unit of claim 2 wherein said section is rectangular and is formed from a single elongated element.

4. A shelf unit of claim 3 wherein the uppermost crossbar of said left side wall and the uppermost crossbar of said right side wall have a plurality of inwardly and downwardly directed indentations, and U-shaped leg members of a shelf unit fit behind and under said indentations of said crossbars of a lower shelf unit for hooking engagement with said crossbars to releasably secure said shelf unit atop said lower shelf unit.

5. A shelf unit of claim 3 wherein said U-shaped leg members have horizontally and outwardly extending feet portions which fit behind and under a crossbar of one of the left and right vertical side walls of a lower shelf unit for hooking engagement with said crossbar to releasably secure said shelf unit atop a lower shelf unit.

6. A shelf unit of claim 1 wherein said crossmembers of said top and bottom surfaces are disposed without said chamber, and said crossmembers of said top surface are located at different distances from said left and right side walls than are said crossmembers of said bottom surface such that said crossmembers of said top surface of a lower shelf unit contact the bottom surface of a shelf unit and the crossmembers of said bottom surface of said shelf unit contact said top surface of said lower shelf unit when said shelf unit is placed atop said lower shelf unit.

7. A shelf unit of claim 1 wherein said bottom surface, top surface, left side wall, and right side wall are formed of metal.

8. The shelf unit of claim 1 wherein said shelf unit includes a divider disposed within said chamber, said divider extending between said top and bottom surfaces of said shelf unit.

9. The shelf unit of claim 8 wherein said divider includes a generally rectangular frame having a top, bottom, left side and right side, a plurality of spaced, generally parallel and coextensive elongated vertical bars extending between said top and bottom of said frame and means on said frame for releasably securing said divider to said shelf unit.

10. The shelf unit of claim 9 wherein said bottom of said frame of said divider includes a gap at the center thereof, a V-shaped bar having two legs joined at an apex to form said V-shape is attached to said divider so that said V-shaped bar abuts and is attached to said elongated vertical bars of said divider and the ends of said legs opposite said apex are attached to said bottom of said frame, one leg on either side of said gap, and said means on said frame for releasably securing said divider to said shelf unit includes a pair of hooks disposed on said bottom of said frame, one hook being disposed on either side of said gap.

11. The shelf unit of claim 8 wherein a second shelf unit, identical to said shelf unit, is spaced laterally apart from said shelf unit and is attached to said shelf unit by a shelf extending between said shelf unit and said second shelf unit.

12. The shelf unit of claim 11 wherein said shelf comprises a plurality of spaced, generally parallel, and coextensive elongated horizontal members and a plurality of spaced, generally parallel and coextensive crossmembers extending generally perpendicularly to said elongated horizontal members, the outermost of said horizontal members and the outermost of said crossmembers forming a generally rectangular frame, and means for releasably securing said shelf to said shelf unit and said second shelf unit.

13. The shelf unit of claim 12 wherein said releasably securing means are hooks attached to said outermost crossmembers which are adapted to coact with a crossbar of said shelf unit and a crossbar of said second shelf unit to secure said shelf to said shelf unit and said second shelf unit so that said shelf extends between said shelf unit and said second shelf unit.

14. A shelf assembly comprising:

first and second shelf units, both said shelf units comprising top and bottom spaced, generally parallel and coextensive horizontal surfaces having outer edges and comprising a plurality of spaced, generally parallel and coextensive elongated horizontal members and a plurality of spaced, generally parallel and coextensive crossmembers extending generally perpendicularly to said elongated horizontal members; left and right spaced, generally parallel and coextensive vertical sidewalls comprising a plurality of spaced, generally of spaced, generally parallel and coextensive crossbars extending generally perpendicularly to said elongated vertical bars, said left and right sidewalls secured to and extending between said outer edges of said top and bottom horizontal surfaces and generally perpendicularly to said top and bottom surfaces to define a chamber; each said sidewall having at least one U-shaped leg member extending downwardly beyond said bottom horizontal surface, each said U-shaped leg member being adapted for hooking engagement with one of said crossbars of one of said sidewalls, between said outer edges of said top and bottom horizontal surfaces, of a lower shelf unit upon which said shelf unit is placed to releasably secure said shelf unit atop said lower shelf unit, said first shelf unit being placed atop said second shelf unit and said legs of said first shelf unit being in hooking engagement with said crossbars of said sidewalls of said second shelf unit to releasably secure said first shelf unit atop said second shelf unit.

15. The shelf assembly of claim 14 wherein at least one of said shelf units includes a divider disposed within said chamber, said divider extending between said top and bottom members of said shelf unit.

16. The shelf assembly of claim 15 wherein said divider includes a generally rectangular frame having a top, bottom, left side and right side, a plurality of spaced, generally parallel and coextensive elongated vertical bars extending between said top and bottom of said frame and means on said frame for releasably securing said divider to said shelf unit.

17. The shelf assembly of claim 16 wherein said bottom of said frame of said divider includes a gap at the center thereof, a V-shaped bar having two legs joined at an apex to form said V-shape is attached to said divider so that said V-shaped bar abuts and is attached to said elongated vertical bars of said divider and the ends of said legs opposite said apex are attached to said bottom of said frame, one leg on either side of said gap and said means on said frame for releasably securing said divider to said shelf unit includes a pair of hooks disposed on said bottom of said frame, one hook being disposed on either side of said gap.

18. The shelf assembly of claim 14 wherein a third shelf unit, said third shelf unit being identical to said first and second shelf units, is spaced laterally apart from said second shelf unit and is attached to said second shelf unit by a shelf extending between said second shelf unit and said third shelf unit.

19. The shelf assembly of claim 18 wherein said shelf comprises a plurality of spaced, generally parallel and coextensive elongated horizontal members and a plurality of spaced, generally parallel and coextensive crossmembers extending generally perpendicularly to said elongated horizontal members, the outermost of said horizontal members and the outermost of said crossmembers forming a generally rectangular frame, and means for releasably securing said shelf to said second shelf unit and said third shelf unit.

20. The shelf assembly of claim 19 wherein said releasably securing means are hooks attached to said outermost crossmembers which are adapted to coact with a crossbar of said second shelf unit and a crossbar of said third shelf unit to secure said shelf to said second shelf unit and said third shelf unit so that said shelf extends between said second shelf unit and said third shelf unit.

* * * * *